US006514302B2

(12) United States Patent
Lemberger et al.

(10) Patent No.: US 6,514,302 B2
(45) Date of Patent: Feb. 4, 2003

(54) METHODS FOR PRODUCING GRANULAR MOLDING MATERIALS FOR ABRASIVE ARTICLES

(75) Inventors: Michael J. Lemberger, Oxford, MA (US); John P. McNamara, Clinton, MA (US); Raymond J. Pellerin, Holden, MA (US); Robert L. Holden, West Boylston, MA (US); René Goutte, Bolton, MA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 09/855,950

(22) Filed: May 15, 2001

(65) Prior Publication Data

US 2002/0184829 A1 Dec. 12, 2002

(51) Int. Cl.[7] ..... B24D 3/28

(52) U.S. Cl. ..... 51/298; 51/295; 51/307; 51/308; 51/309; 523/351; 264/109; 264/319; 264/327

(58) Field of Search ..... 51/298, 295, 307, 51/308, 309, 293; 264/109, 319, 327, 348; 523/149, 351; 525/480

(56) References Cited

U.S. PATENT DOCUMENTS

| | | | | |
|---|---|---|---|---|
| 2,862,806 | A | 12/1958 | Nestor | |
| 2,901,337 | A | 8/1959 | Keutgen et al. | |
| 3,619,151 | A | 11/1971 | Sheets et al. | 51/307 |
| 3,806,327 | A | 4/1974 | Farmer et al. | 51/295 |
| 3,850,589 | A | 11/1974 | Charvat | 51/296 |
| 3,878,160 | A | 4/1975 | Grazen et al. | 260/38 |
| 4,099,934 | A | 7/1978 | Suzuki et al. | 51/295 |
| 4,110,939 | A | 9/1978 | Bodolai | 51/298 |
| 4,239,503 | A | 12/1980 | Harris et al. | 51/298 |
| 4,245,399 | A | 1/1981 | Müller et al. | |
| 4,264,557 | A | 4/1981 | Annis | 264/328.1 |
| 4,404,003 | A | 9/1983 | Harris | 51/298 |
| 4,588,420 | A | 5/1986 | Charvat | 51/298 |
| 4,770,907 | A | 9/1988 | Kimura | 427/217 |
| 4,918,116 | A | 4/1990 | Gardziella et al. | 523/149 |
| 5,089,032 | A | 2/1992 | Moran | 51/293 |
| 5,131,923 | A | 7/1992 | Markhoff-Matheny et al. | 51/293 |
| 5,399,606 | A | 3/1995 | König et al. | 524/385 |
| 5,611,827 | A | 3/1997 | Hammarstrom et al. | 51/298 |
| 5,658,360 | A | 8/1997 | Keil | 51/298 |
| 5,681,875 | A | * 10/1997 | Huang et al. | 523/351 |
| 5,707,409 | A | 1/1998 | Martin et al. | 51/295 |
| 5,827,337 | A | 10/1998 | Keil | 51/298 |
| 5,976,204 | A | 11/1999 | Hammarstrom et al. | 51/298 |

FOREIGN PATENT DOCUMENTS

| | | |
|---|---|---|
| JP | 54077390 | 6/1979 |
| JP | 62246474 | 10/1987 |
| SU | 935260 | 6/1982 |
| SU | 1423363 | 9/1988 |
| SU | 1611719 | 12/1990 |
| SU | 1798148 | 2/1993 |

OTHER PUBLICATIONS

Kirk–Othmer Encyclopedia of Chemical Technology, Third Edition, vol. 17, pp. 384–416 (no date).

Bakelite® publication, *Rutaphen®—Resins for Grinding Wheels—Technical Information*, (KN 50E –09.92—G&S–BA). (no date).

Bakelite® publication, *Rutaphen®—Phenolic Resins—Guide/Product Ranges/Application* (KN107/E—10.89 GS–BG), (no date).

Thermosetting Plastics, edited by J.F. Monk, Chapter 3 ("Compressing Moulding of Thermosets"), 1981 George Goodwin Ltd. in association with The Plastics and Rubber Institute (no month).

* cited by examiner

*Primary Examiner*—Michael Marcheschi
(74) *Attorney, Agent, or Firm*—Mary E. Porter

(57) ABSTRACT

Granular molding materials for fabricating abrasive articles, such as, for example, grinding wheels, are produced by mixing heated abrasive grains with a resin blend including two phenol-novolac resins. Preferably, the resin blend is added to the abrasive grains in the mixer apparatus of the invention, which can be a bowl type mixer. The mixer can be preheated by directing a heated gas, such as air, across the mixer. The granular molding material can also include a curing agent, fillers and other materials generally employed in fabricating abrasive articles.

37 Claims, 2 Drawing Sheets

METHODS FOR PRODUCING GRANULAR MOLDING MATERIALS FOR ABRASIVE ARTICLES

BACKGROUND OF THE INVENTION

Resin-bonded abrasive articles, such as grinding wheels, typically are produced by mixing discrete abrasive particles with a liquid binder material and a powder resin and then pressing the mixture together under appropriate thermal conditions. The mixture can include other constituents such as, for example, fillers, curing agents, wetting agents and various metal powders.

A number of processes for fabricating abrasive articles employ novolac resins. In one approach, novolac resins are provided as solvent-based systems. One common disadvantage of this approach is ignitability of the solvent at high temperatures. Although solvent-free modified novolac resins have been developed, these materials are often expensive and their commercial use may not be economical.

Another approach for making abrasive articles is a multi-step process that includes applying a heated liquid novolac resin to the abrasive particles, followed by applying a dry bonding material. Typically, the dry bonding material includes another novolac resin and a curing agent. The sequence can be repeated until enough resin and bonding material has been added.

Some of the techniques currently available require the use of wetting agents, such as furfural. Wetting agents, in turn, can result in unstable molding mixtures and can generate a large amount of dust. Many known techniques require painstaking controls of temperature and/or addition of materials employed in order to obtain a suitably homogeneous granular molding material.

Therefore, a need exists for producing abrasive articles by methods which overcome or minimize the above-referenced problems.

SUMMARY OF THE INVENTION

The invention is directed to methods for producing a granular molding material for abrasive articles.

One method of the invention includes heating a granular abrasive material, blending a first phenol-novolac resin with a second phenol-novolac resin to form a resin blend and mixing in a vessel the heated granular abrasive material and the resin blend, thereby producing the granular molding material. Optionally, the vessel is preheated.

In one specific embodiment, the granular abrasive material is heated to a temperature in a range of between about 80° C. and about 130° C. In another embodiment, the temperature of the granular abrasive material is controlled by directing a gas across the vessel. In yet another embodiment, the vessel is preheated by directing a heated gas across the vessel. In a preferred embodiment, the first novolac resin is blended with the second novolac resin by spraying the first novolac resin onto the second novolac resin. In another preferred embodiment, the second novolac resin is combined with a curing agent prior to forming the resin blend. In a further preferred embodiment, the second novolac resin is combined with a filler prior to forming the resin blend. In yet another preferred embodiment, the method further includes the steps of molding and curing the granular molding material.

Granular molding material for abrasive articles can be prepared in an apparatus of the invention which includes a mixing vessel and means for directing a heated gas across or into the vessel. Optionally, the vessel is insulated with an insulation material.

The invention has numerous advantages. For example, the invention can be used to produce flowable granular molding materials which are homogeneously coated with phenol novolac resins. The materials obtained by practicing the invention give uniform tool structure with evenly distributed abrasive grain. The amount of loose, non-adhering material left in the mixing vessel after removal of the granular molding material is reduced or minimized. Compared to other methods, the invention also is advantageous with respect to dust generation and the stability of the granular molding material produced. The invention also reduces difficulties commonly associated with metering of resin. Further, the invention can be conducted employing simple, independent and flexible temperature controls. By using a preheated vessel in combination with preheated abrasive grain, a continuous rather than a batch-mode process can be employed to produce granular molding material.

DETAILED DESCRIPTION OF THE INVENTION

Figure 1:
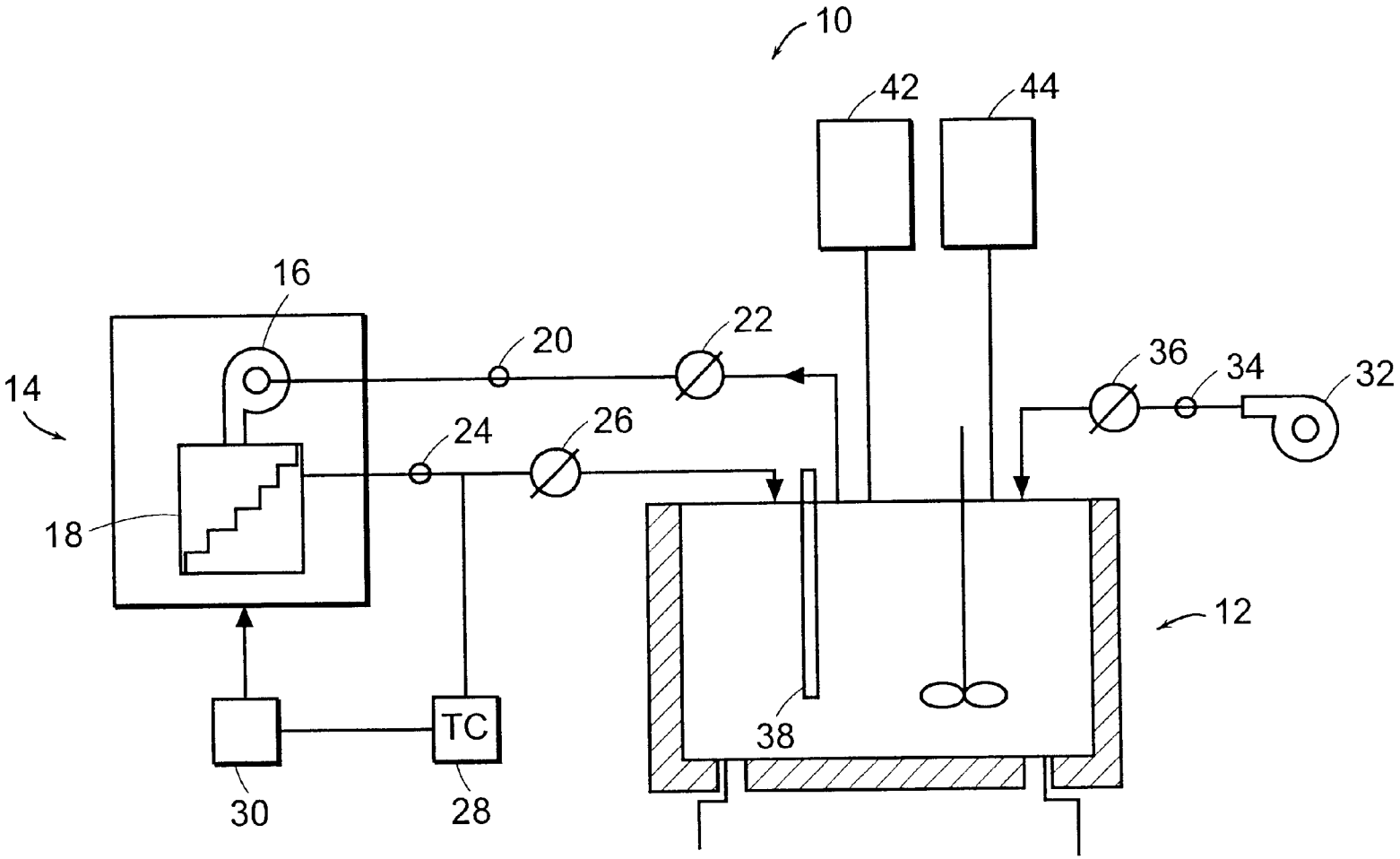
FIG. 1 is a schematic representation, partly in cross section, of an apparatus which can be employed to conduct the method of the invention.

The foregoing and other objects, features and advantages of the invention will be apparent from the following more particular description of preferred embodiments of the invention, as illustrated, in part, by reference to the accompanying drawing. The drawing is not necessarily to scale, emphasis instead being placed upon facilitating description of the method of the invention.

The invention generally is directed to methods for producing a granular molding material for producing abrasive articles. The methods include, in various embodiments, heating a granular material, such as by preheating a vessel and adding the granular material to the preheated vessel, and adding first and second novolac resins, either separately or as a blend, to the heated abrasive grain in the vessel.

In a preferred embodiment, granular abrasive material is added to the vessel prior to the addition of the phenol-novolac resins. In an especially preferred embodiment, a phenol-novolac resin blend is added to heated granular abrasive material in the vessel. Granular abrasive material can also be added during or after the addition of one or both phenol-novolac resins to a mixing vessel.

FIG. 1 is a schematic representation, shown partly in cross section, of one embodiment of apparatus suitable for conducting the method of the invention. It is to be understood that, although the method of the invention will be described with reference to the apparatus represented in FIG. 1, the method of the invention can be conducted by other suitable apparatus.

Apparatus 10 includes bowl-type mixer 12. Mixer 12 can be fabricated from stainless steel, plastics or other suitable materials. Examples of suitable bowl-type mixers include Eirich (Model RV02) and Littleford bowl type mixers, e.g. Model FM-130D, manufactured by Littleford Day, Inc., Florence, Ky., Materninni mixers, manufactured by M. D.

M. di Davide Materninni, Italy, and others. Mixer 12 can be insulated, as shown. In one embodiment, mixer 12 is heated to a temperature in a range of between about 20° C. and about 150° C., preferably between about 25° C. and about 50° C. Mixer 12 can be heated by activating heater 14 and recirculating gas between mixer 12 and heater 14. Heater 14 includes blower 16 and heating element 18. A suitable gas is recirculated between mixer 12 and heater 14 by conducting gas from mixer 12 through conduit 20 and valve 22 to heater 14, and from heater 18 through conduit 24 and valve 26 back to mixer 12. The temperature of gas directed into mixer 12 can be regulated by thermocouple 28 located at conduit 24, and by controller 30. Examples of suitable gas that can be employed for recirculation to heat mixer 12 include air, nitrogen gas, carbon dioxide, and argon.

Cooling gas can be directed into mixer 12 through blower 32, conduit 34 and regulating valve 36. Regulation of heating and cooling gases through mixer 12 can be automatically controlled by regulating valves 22, 26 and 36 in conjunction with the monitoring the temperature in conjunction with mixer 12, by use of a temperature measurement device 38 (e.g., a thermometer or thermocouple).

Granular abrasive material is added to mixer 12 from source 42. The granular abrasive material can be, for example, a conventional abrasive, a superabrasive or combination thereof. Conventional abrasives include, but are not limited to: aluminum oxide, silicon carbide, zirconia-alumina, garnet, emery, and flint. Superabrasives include, but are not limited to: diamond and cubic boron nitride (CBN). Various combinations or mixtures of abrasive materials are also contemplated, such as, for example, mixtures of aluminum oxide and zirconia alumina. Another example of suitable abrasives are sol-gel derived abrasives. Examples of these are sol-gel alumina abrasive grits, which can be seeded or unseeded. These types of materials are described, for example, in U.S. Pat. No. 5,131,923, incorporated herein by reference in its entirety. The total amount of abrasive material employed in the methods described below, generally is in a range of between about 40 and about 70 volume percent of a resulting abrasive article or tool.

The average particle size of the grains (sometimes referred to as "grit") of the granular abrasive material selected can be determined by a variety of factors, such as the particular abrasive utilized, as well as the end use of abrasive tools to be fabricated. In general, an average particle size for suitable superabrasives and conventional abrasives is in a range of about between 0.5 and about 5000 micrometers and, preferably, in a range of between about 2 and about 200 micrometers. Those of ordinary skill in the art will be able to select the most appropriate abrasive particle size for a desired application without undue experimentation.

The granular abrasive material is heated to a temperature in the range of between about 30° C. and about 150° C. In a preferred embodiment, the abrasive material is heated to a temperature in a range of between about 80° C. and about 130° C.

It is to be understood that the granular abrasive material can be heated before or after it has been added to mixer 12. In a preferred embodiment, granular abrasive material is heated in a fluid bed. Ovens and other arrangements also can be employed to heat granular abrasive material outside mixer 12.

Typically, once granular abrasive material has been added to mixer 12 and has been heated, valves 22, 26 and 36 are closed and heater 14 is deactivated.

First and second phenol novolac resins are mixed with the abrasive grain in mixer 12. First phenol-novolac resin has a phenol-to-formaldehyde molar ratio in a range of between about 1:0.2 and about 1:0.35. Preferably, the content of free phenol is less than about 0.5%. The first phenol-phenol-novolac resin has a preferred molecular weight in a range of between about 200 and about 1000, weight average. Generally, it has a melting point above about 25° C. Preferably, at about 70° C., the first phenol-novolac resin has a relatively low melting viscosity, such as a viscosity in a range of between about 300 and about 3,000 cp, so that it is relatively it easy to handle and blend with other components. An example of a suitable first phenol-novolac resin is described in U.S. Pat. No. 4,918,116 issued to Gardziella, et al. on Apr. 17, 1990 (Gardziella, et al.) and incorporated herein by reference in its entirety.

The nature of the second phenol-novolac resin is not critical, although its phenol-formaldehyde ratio preferably lies outside of the ratio of the first phenol-novolac resin. This second phenol-novolac resin can, for example, be one of the materials generally described in the *Kirk-Othmer Encyclopedia* of Chemical Technology, Third Edition, Volume 17, pages 384 to 416, the contents of which are incorporated herein by reference in its entirety. Preferably, the second phenol-novolac resin has a phenol-to-formaldehyde molar ratio in a range of between about 1:0.5 and about 1:0.9. A preferred molecular weight of the second phenol-novolac is in the range of about 2,000 to about 15,000. An especially preferred molecular weight range is usually about 5,000 to about 12,000. Examples of suitable second phenol-novolac resins are described in U.S. Pat. No. 4,264,557 (Annis) and U.S. Pat. No. 3,878,160 (Grazen et al.), both of which are incorporated herein by reference in their entirety.

The weight ratio of the first phenol-novolac resin to the second phenol-novolac resin usually is in a range of between about 7:1 and about 1:7. An especially preferred ratio lies in a range of between about 3:1 and about 1:3.

In one embodiment of the invention, the content of the first phenol-novolac resin with respect to that of the second phenol-novolac resin is optimized for a temperature of mixing, further discussed below, which is between about 90° C. and about 130° C. For instance, in one preferred embodiment, at a mixing temperature of about 90° C. and employing first and second phenol-novolac resins described in Example 1, the volume of the first phenol-novolac resin should not exceed 11% of the total volume of the abrasive mixture. In another preferred embodiment, at a mixing temperature of about 130° C., and employing first and second novolac resins described in Example 1, the volume of the first novolac resin should not be less than 9% of the total volume of the abrasive mixture. In a preferred embodiment 35% to 50% volume of the second phenol novolac resin is used with 50% to 65 volume % of the first novolac resin. The corresponding weight ratio of the first phenol-novolac resin to the second phenol-novolac resin is about 0.7:1.0 to 1.5:1.0.

In one embodiment of the invention, the first phenol-novolac resin and the second phenol-novolac resin are added simultaneously to granular abrasive material in preheated mixer 12. An example of simultaneous addition of novolac resins is described, for example, in U.S. Pat. No. 5,611,827, issued to Hammerstrom, et al. on Mar. 18, 1997 and in U.S. Pat. No. 5,976,204, issued to to Hammerstrom, et al. on Nov. 2, 1999; the teachings of both are incorporated herein by reference in their entirety. Herein, the terms "blend" or "blending" are used interchangeably with "mixture" or "mixing." As used herein, "blending" the first phenol-novolac resin with the second phenol-novolac resin means mixing together, dispersing or distributing one phenol-novolac resin into the other. The term "resin blend" is used herein to describe the resulting homogeneous, intimate polymer mixture or polymer blend in which each of the two phenol-novolac resins employed retains its own distinct physical and chemical characteristics.

The first phenol-novolac resin can be blended with granular abrasive material and/or with the second phenol-novolac resin while in solid form or as a fluid, sometimes referred to as a "hot-melt." In one embodiment, the second phenol-novolac resin to be blended is in solid form, such as, for example, in the form of a powder. The second phenol-novolac resin can be provided in combination with other components in the form of a powder mixture, often referred to as a "dry bond" or "dry bonding" powder or material.

Blending the first phenol-novolac resin with the second phenol-novolac resin can be by any suitable means, such as by mechanical mixing. For example, the first phenol-novolac resin, in solid form, can be distributed throughout the dry bonding powder in a mechanical mixer. Preferred mixers generate relatively low amounts of heat and/or provide effective cooling, thereby preventing a decrease in the viscosity of the phenol-novolac resins being blended. The mixer can be, for example, a Littleford™ type mixer. Littleford™ mixers are known in the art. Generally, they are high intensity plow type mixers with a high sheer rotor and cooling jacket. Bowl type and Eirich™ mixers can also be employed to form the resin blend.

In one embodiment of the invention, the first phenol-novolac resin, is crushed into solid resin chunks ranging in size from about 2.5 to about 17 cm, and comminuted into smaller size particles of about 5 to 500 micrometers prior to blending it with the second phenol-novolac resin. For example, suitable particles of the first phenol-novolac resin typically range in size from about 50 to about 500 micrometer ($\mu$m) and can be pulverized into smaller particles ranging in size from about 5 to about 50 $\mu$m by, for example, attrition, milling, grinding or hot-melt spraying. Examples of suitable attrition and milling equipment which can be employed include, but are not limited to, SDG™ Dry Grinding Attritors, obtained from Union Process, Inc., Akron, Ohio and other types of milling equipment known in the art. Reduction in particle size also can be conducted during blending with the second phenol-novolac resin. Softening of the first phenol-novolac resin during particle size reduction operations can be minimized or prevented by cooling the first phenol-novolac resin below its melting temperature, preferably by contact with dry ice or a cryogenic liquid such as, for example, liquid nitrogen.

In another embodiment of the invention, the first phenol-novolac resin is employed in fluid form. For example, the first phenol-novolac resin can be melted by heating the resin to a temperature in a range of between about 100° C. and about 130° C. to obtain a suitable viscosity, such as a viscosity in a range of between about 300 centipoise (cp) and about 700 cp. The fluid can be atomized and the resulting droplets sprayed onto the second phenol-novolac resin, preferably in the form of a dry bond powder composition, such as described above.

Examples of suitable equipment which can be used in spraying hot melt include, but are not limited to, atomizers such as, for instance, Graco, Therm-o-Flow™, Nordson, MX mixing series, Pyles, Hot melt and Zenith Pumps EAZ-60.

Round and flat air atomizing nozzles, having a size between about 60/100 and about 100/150 thousands of an inch, are preferred. Atomization parameters which can be employed are: liquid flow rates ranging from about 10 and about 70 pounds/minute (lbs/min), preferably between about 20 and about 50 lbs/min; and air pressure at the nozzle ranging from about 30 to about 50 pounds per square inch (PSI). Preferred temperatures of the first novolac resin range between about 95° C. to about 125° C.

The sprayed first phenol-novolac resin is then blended with the second phenol-novolac resin powder. Preferred starting temperatures of the second phenol-novolac resin range from about 22° C. to about 27° C. and preferred finish temperatures of the second phenol-novolac resin range from about 35° C. to about 60° C. Techniques which can be employed to blend the sprayed first phenol-novolac resin and the second phenol-novolac resin powder include, for example, mechanical blending or air blending. For example, mechanical blending can be conducted in a mixer or bowl provided with paddles. Examples of such a mixer include, but are not limited to Littleford™ FM series mixers, Maternini single bowl and paddle blender, Eirich mixers and others. A suitable example of an air blender is the MAC Equipment Air Blender.

In preferred embodiments, additional materials, such as, for example, curing agents, fillers and other ingredients also are introduced into mixer. Suitable curing agents employed to cross-link the phenol-novolac resins described above, are known in the art. They are described, for example, in the above-mentioned patent of Grazen et al. For example, various amines can be used, such as ethylene diamine; ethylene triamine; methyl amines; and hexamethylene tetramine ("hexa"). Precursors of such materials can also be used. As an example, ammonium hydroxide is a suitable curing agent because it reacts with formaldehyde to form hexa. Hexa and its precursors are the preferred curing agents. Mixtures of curing agents can also be employed.

Effective amounts of the curing agent can be determined without undue experimentation. Usually, about 5 to about 20 parts (by weight) of curing agent are employed per 100 parts of total phenol-formaldehyde resin. Those of ordinary skill in the art of resin-bound abrasive articles will be able to adjust this level, based on various factors, e.g., the particular types of resins used; the degree of cure needed, and the desired final properties for the articles: strength, hardness, and grinding performance. In the preparation of abrasive wheels, an especially preferred level of curing agent lies in the range of about 8 parts to about 15 parts by weight.

Other materials that can be employed to form the granular molding materials of the invention include fillers as well as other ingredients typically employed in making abrasive articles. Non-limiting examples of suitable fillers include sand, silicon carbide, alumina, bauxite, chromites, magnesite, dolomites, mullite, borides, fumed silica, sol gel materials, titanium dioxide, carbon products (e.g., carbon black, coke, or graphite); corundum, wood flour, clay, talc, hexagonal boron nitride, molybdenum disulfide, zirconia, and various forms of glass, such as glass fiber. Mixtures of more than one filler are also possible.

The effective amount for each filler or combination of fillers can be determined by those of ordinary skill in the art. The usual level of fillers for this invention is about 0.1 to about 30 parts by weight, based on the weight of the entire composition. In the case of abrasive discs, the level of filler material usually in the range of about 5 to 20 parts by weight, based on the weight of the disc.

Other ingredients typically employed in making abrasive articles include antistatic agents; metal oxides such as lime, zinc oxide, magnesium oxide, and mixtures thereof; and lubricants such as stearic acid and glycerol monostearate. As in the case of fillers, the appropriate amount of each of these materials can readily be determined by those skilled in the art.

The curing agent, fillers and/or other ingredients typically employed in making abrasive articles can be combined with the granular abrasive material, the phenol-novolac resins or with the combination of granular abrasive material and phenol-novolac resins as known by those skilled in the art. The curing agent, fillers and/or other ingredients can be combined also with the blend of first and second phenol-novolac resins. In preferred embodiments of the invention, the second phenol-novolac resin is provided as part of a dry bonding powder composition, which, in addition to the phenol-novolac resin, can include all or part of the curing agent. The dry bonding powder composition can also include fillers as well as other components employed in making abrasive materials. In such an instance, the curing agent usually constitutes about 0.1 % to 20% by weight, and preferably about 7% to 14% by weight, of the total weight of phenol-phenol-novolac resins to be included in the molding material.

The granular abrasive material and phenol-novolac resins are mixed in mixer 12, to produce the granular molding material for abrasive articles. In an especially preferred embodiment, the resin blend is directed from source 44 to preheated abrasive material in mixer 12, although it is to be understood that the first and second phenol-novolac resins can be blended in the mixing vessel prior to addition of the abrasive granular material. Mixing times depend on a variety of factors related to processing and materials, e.g., the type of abrasive and binder resins employed, the presence or absence of fillers; the type and capacity of mixer equipment used; the quantities of materials being processed, etc. In general, mixing time will range from about 3 minutes to about 6 minutes for a smaller scale of processing, e.g., 50 pounds total material; and from about 3 minutes to about 8 minutes for a larger-scale situation, e.g., up to about 600 pounds total material. Those of ordinary skill in abrasives processing will be able to select the most appropriate mixing time, based in part on the teachings herein.

The optimal mixing temperature depends, at least in part, on the abrasive grain and the specific phenol-novolac formulations employed to produce the granular molding material. Generally, the mixing step is carried out employing an initial temperature of abrasive grain in the range of between about 100° C. and about 150° C. The mixer (bowl) temperature can be at room temperature or can be heated. Bowl temperatures between 25° C. and 50° C. are preferred. The mixing process is preferably carried out at temperatures ranging from about 85° C. to about 110° C.

In one embodiment of the invention, an increase in content of the first phenol novolac resin is accompanied by employing a lower temperature of mixing. However, too low a temperature with increased content levels of the first phenol-novolac resin can result in unstable and irreproducible results. Similarly, unstable mixing conditions can occur with lowered contents of the first novolac resin accompanied by a mixing temperature that is too high.

The temperature of the combined granular abrasive material and phenol-novolac resin blend can be controlled during mixing. For example, a cooling gas, such as ambient air, can be directed to mixer 12 by opening valve 36 and activating blower 32. During mixing, the flow rate of cooling gas to mixer 12 preferably is low, and ranges, for example, between about 100 and about 500 cubic feet/second ($ft^3$/sec). Typically, the temperature of the mixture decreases during mixing to a final temperature in a range of between about 60° C. and about 90° C. The temperature drop can be beneficial in some respects, since it tends to inhibit premature cure and agglomeration of the abrasive/resin system.

The resulting granular molding material can be further cooled by cooling gas, preferably at a higher flow rate, such as, for example, ranging between about 300 and about 3000 $ft^3$/sec. Once the granular molding material has been cooled to a desired temperature, such as, for example, in a temperature in a range of between about 60° C. and about 40° C., blower 32, valve 36 and motors driving the pan and paddles of mixer 12 are turned off, and the granular molding material is removed from mixer 12.

After completion of the above-described process, the abrasive gains in the present invention are coated with the first and second phenol-novolac resins. Homogeneity of the coating can be determined by examination of the grains. The absence of significant regions where the dry bond (i.e., the second phenol-novolac resin and associated fillers) is excessively concentrated often is apparent. Similarly, the absence of significant tacky, "resin-rich" regions is noted, i.e., areas with excessive concentrations of the first phenol-novolac resin.

Homogeneity is further demonstrated by a reduced amount of "loose material," i.e., material which does not adhere to the abrasive grains. Loose material can include phenol-novolac resins, curing agent, fillers and other ingredients. Material that does not adhere to the granular abrasive material during mixing can cause significant processing complications. The total amount of material which does not adhere to the abrasive grains after the mixing step generally should be less than about 3% by weight, based on the total weight of the molding material. In preferred embodiments, the amount is less than about 1.5%. In especially preferred embodiments, e.g., where the molding material is to be used for the preparation of high performance abrasive discs, the amount of this non-adherent material generally should be less than about 0.5%.

The granular molding material produced by the methods of the invention can be stored for later use. Alternatively, the molding material can be used immediately to prepare the abrasive articles of interest. Usually, it is first passed through a screen to remove any agglomerates, and then conveyed directly to molding equipment. Thus, in preferred embodiments, there is no aging step between blending and molding, unlike most of the processes of the prior art. Since an aging step can be costly and time-consuming, elimination of such a step often is a considerable advantage from a commercial point of view.

The molding materials may be molded, i.e., "pressed," by many of the techniques, such as those known in the art. Hot pressing, warm pressing, or cold pressing can be employed. Hot pressing is described, for example, in a Bakelite® publication, *Rutaphen®-Resins for Grinding Wheels—Technical Information*. (KN 50E -09.92-G&S-BA), and in another Bakelite® publication: *Rutaphen® Phenolic Resins—Guide/Product Ranges/Application* (KN107/E -10.89 GS-BG), both of which are incorporated herein by reference. Useful information can also be found in Thermosetting Plastics, edited by J. F. Monk, Chapter 3 ("Compression Moulding of Thermosets"), 1981 George Goodwin Ltd. in association with The Plastics and Rubber Institute. This publication is also incorporated herein by reference. To illustrate, an abrasive disc or grinding wheel can be prepared by placing the blended material in an appropriate mold, usually made of stainless-, high carbon-, or high chrome-steel. Shaped plungers may be employed to cap off the mixture. Cold preliminary pressing sometimes is used, followed by preheating after the loaded mold assembly has been placed in an appropriate furnace. The mold assembly can be heated by any convenient method: electricity, steam, pressurized hot water, or gas flame. A resistance- or induction-type heater is usually employed. A suitable inert gas, such as nitrogen, can be introduced to minimize oxidation of the mold.

The specific temperature, pressure and time ranges will depend on the specific materials employed, the type of equipment in use, and the dimensions of the wheel. The molding pressure usually ranges from about 0.5 tons per square inch (tsi) to about 5.0 tsi, and preferably, from about 0.5 tsi to about 2.0 tsi. The pressing temperature for this process typically is in the range of about 115° C. to about 200° C.; and preferably, from about 140° to about 170° C. The holding time within the mold usually is about 30 to about 60 seconds per millimeter of abrasive article thickness.

For the purpose of this disclosure, the scope of the term "hot pressing" includes hot coining procedures, which are known in the art. In a typical hot coining procedure, pressure is applied to the mold assembly after it is taken out of the heating furnace.

Cold pressing and warm pressing are the preferred techniques for this invention, especially in embodiments where energy-and time-conservation requirements are critical. Cold pressing is described in U.S. Pat. No. 3,619,151, which is incorporated herein by reference. A predetermined weighed charge of the blended composition is initially delivered to and evenly distributed within the cavity of a suitable mold, e.g., a conventional grinding wheel mold. The material remains at ambient temperature, usually less than about 30° C. Pressure is then applied to the uncured mass of material by suitable means, such as a hydraulic press. The pressure applied typically will be in the range of about 0.5 tsi to about 15 tsi, and more preferably, in the range of about 1 tsi to about 6 tsi. The holding time within the press usually will be in the range of about 5 seconds to about 1 minute. It appears that the compacting pressure necessary for favorable results can be reduced up to about 20% by the use of lubricant-type materials such as graphite and stearates.

Warm pressing is a technique very similar to cold pressing, except that the temperature of the blended mix in the mold is elevated, usually to some degree below about 140° C., and more often, below about 100° C. The same general pressure and holding time parameters followed for cold pressing are followed here.

After either cold or warm pressing, the molded material usually is cured. Selection of a curing temperature depends on several factors, including the strength, hardness, and grinding performance desired for the particular abrasive article. Usually, the curing temperature will be in the range of about 150° C. to about 250° C. In more preferred embodiments, the curing temperature will be in a range of between about 150° C. and about 200° C. Curing time will range from about 6 hours to about 48 hours. In many instances, the final curing temperature is reached in steps, i.e., passing through intermediate temperatures and holding periods. Such a technique enhances additional wetting of the dry components in the mixture with the liquid components. Those of ordinary skill in the abrasive arts will be able to select an appropriate cure schedule without undue experimentation.

After pressing and curing (in the case of cold or warm pressing) is completed, the abrasive articles are stripped from the mold and cooled. Subsequent steps are also possible, e.g., the edging and finishing of abrasive wheels, according to standard practice. For this invention, the porosity of the molded article after curing usually is in a range of between about 0% and about 50%, and most often, in a range of between about 4% and about 30%.

The invention is further described through the following examples which is provided for illustrative purposes and is not intended to be limiting.

EXEMPLIFICATION

Example 1

The materials employed in making thin cut-off wheel samples A and B, included 57A fused alumina abrasive grain of grit size 24 and 57A fused alumina of abrasive grain of grit size 30. The fused alumina abrasive grain was obtained from Treibacher Schleifmittel, Laufenburg, Germany. The formulations included also liquid phenol-novolac resin (low molecular weight) obtained from Bakelite AG, Iserlohn-Lethmate, Germany under the commercial designation of 8505 F resin. Powder phenol-novolac resin (high molecular weight), referred herein as "powdered bond," also was obtained from Bakelite AG, Iserlohn-Lethmate, under the commercial designation of 0222 SP resin. Powders of 0222 SP resin, hexa (i.e., hexamethylene tetramine), iron pyrite and potassium sulfate were dry blended first, then used in the process of the invention for making the mix. Samples A and B employed the formulation shown in Table 1.

TABLE 1[a]

| Material | Weight (LB.) | Specific Gravity ($g/cm^3$) | Volume ($cm^3$) | Volume % |
|---|---|---|---|---|
| 57A grain (24 grit) | 37.99 | 3.95 | 4362.99 | 24.00 |
| 57A grain (30 grit) | 37.99 | 3.95 | 4362.99 | 24.00 |
| 0222SP resin | 6.16 | 1.28 | 2181.49 | 12.00 |
| 8505 resin | 5.14 | 1.23 | 1896.04 | 10.43 |
| Hexa | 0.84 | 1.33 | 285.45 | 1.57 |
| Iron Pyrite | 7.61 | 4.75 | 727.16 | 4.00 |
| $KSO_2$ | 4.26 | 2.66 | 727.16 | 4.00 |

[a]Wheels contained 20 volume % porosity.

Sample A was prepared as described in U.S. Pat. Nos 5,611,827 and 5,976,204, by introducing heated 8505 F resin and powdered bond simultaneously to heated abrasive grain in a mixing bowl manufactured by M. D. M. di Davide Materninni, Italy.

Sample B was prepared according to a preferred embodiment of the invention. Hot liquid 8505 F resin, at about 130° C. was atomized using a Graco Model 57281 heated 5 gallon Supply and Batch Dispenser with Automatic Gun. A Graco #163451 nozzle was used. The air pressure at the nozzle was 2–4 bars (30–60 pounds per square inch (psi)) at 90° C. and the liquid feed pressure was 3 bars (45 psi). The hot 8505 F resin droplets were sprayed onto 0222SP powdered bond resin, at room temperature, to produce a resin blend.

The mixer employed to form granular molding material suitable for fabricating abrasive articles was from M. D. M. di Davide Materninni, Italy. It had a single bowl with a single rotating paddle design and a maximum capacity of 22.5 kg. The bowl was constructed from ultra-high density polyethylene. The paddle was fitted with two sets of pin rakes and one bottom plow. The mixing system was heated by an electrical air heating system. The cooling rate of the mixing process was monitored via two thermocouples installed in the lid of the mixer cover. A hand held thermocouple was used to measure bowl temperature before and after mixing. The mixer was preheated to a temperature of about 30–40 ° C.

Abrasive grain, which had been heated to about 100–120° C. in an oven, was added to the mixer, the mixer was started and then the resin blend was added to the heated grain. Pan temperature was about 35° C., pan speed about 32 RPM and paddle speed about 100 RPM. Mixing times of several minutes were used.

Figure 2:
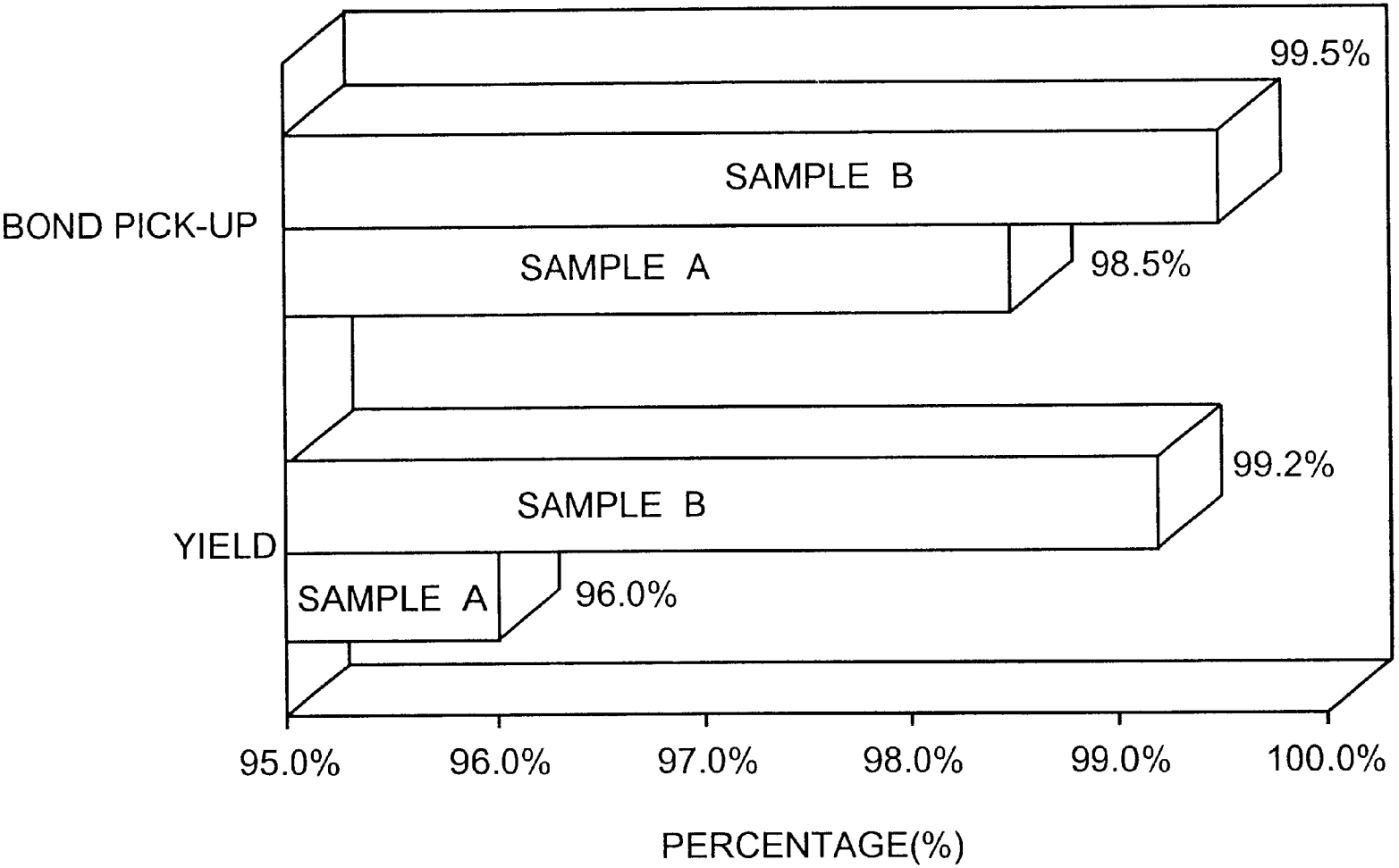
FIG. 2 is a plot comparing the bond pick-up and yield of a conventional method with the bond pick-up and yield obtained in one embodiment of the invention.

Yield % was determined by screening the mix through two screens (minimum and maximum) selected on the basis of abrasive grain size. Yield % for Samples A and B is shown in FIG. 2. Sample B, made by the process of the invention, had a higher yield %.

The test employed to determine the percent bond pickup for organic mixes is described below. Bond not included in the mix pickup was considered loose bond. This test was designed for testing 60 grit and coarser specifications.

The equipment used to conduct the test included: a one half pint screw top container for mix storage; a screen for screening mix prior to testing; a scale capable of weighing 100 grams to the nearest 0.1 gram; two quart plastic container for mix transfer; and Mix Pickup test machine with an 80 mesh screen "squirrel cage", provided with a timer. A representative 100 gram sample of screened mix, weighed to the nearest 0.1 grams, was added to the squirrel cage and the machine was started and operated for 30 seconds as set by the timer. The conical portion of the cage was rapped, once per second, to minimize sticking to the screen. After the machine stopped, the squirrel cage was removed from the test machine and inverted over a two quart container to empty the mix. The squirrel cage was lightly rapped to dislodge mix. Two samples from the two quart container were weighed to the nearest 0.1 gram. If agreement between the measurements for the two samples was higher than 0.6%, the protocol called for measuring a third sample. The weight was recorded as percent mix pickup. For example, 95.6 grams was equal to 95.6% mix pickup.

Comparison results for the methods of forming Sample A and Sample B are shown in FIG. 2. The results indicated that the method of the invention (Sample B) resulted in reduced loose material (higher bond pick-up) and an improved minimum and maximum, with fewer production losses.

Example 2

A Taguchi $L_{18}$ ($2^1 \times 3^7$) experimental design was conducted to further optimize process parameters. The seven process variables investigated were: mixer feed location, starting temperature of the abrasive, starting bowl temperature, pan speed, paddle speed, particle size, mixing time.

Three response variables were used in the analysis: (1) mix rank, which was a qualitative measurement of the mix quality based on the mix being dusty/dry or tacky/wet; (2) mix loss (the amount of mix left on top of the screen after screening; and (3) pan coat, determined by measuring the weight of the pan before and after mixing. A criteria for a good mix was one in which there was minimal dust and the mix was a free-flowing particulate mixture. The material left on top of the screen was considered wasted for the purpose of this experiment. This material, however, could be crushed and reintroduced to the mixer. The pan coat was material built-up on the pan and the optimal process conditions were those that minimized it.

The process parameters found to have a significant influence on mix quality were: abrasive temperature, bowl temperature, paddle speed and the first phenol-novolac 8505 resin particle size. Further, it was noted that the smaller the 8505 resin particle size, the lower was the amount of heat necessary for coating the abrasive.

Abrasive temperature, bowl temperature and particle size were the most important parameters impacting the mix loss. The data suggested that a lower abrasive temperature (e.g., from about 110 to less than 125° C.) and average resin particle size (e.g., 53–250 micrometers; 270–60 mesh) tended to minimize lost material.

Abrasive temperature, bowl temperature, paddle speed, particle size and mixing time were found to be important with respect to avoiding the undesirable effects of pan coat, e.g. lowered yield % mix.

For the type of cut-off wheels and mixer described in Example 1, optimum mixer yield and bond pick-up were achieved at an abrasive temperature of 120° C.; a bowl temperature of 35° C.; a paddle-speed of 100 rpm with a pan speed of 32 rpm and about 5 minutes of mixing time. These optimum conditions were determined for abrasive mix batch sizes of 18.2 kg. (40 lbs.). Thus the feed rate was 0.87 kg.m/in. (1.9 lb./min.).

EQUIVALENTS

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for producing a granular molding material for abrasive articles comprising the steps of:

(a) heating a granular abrasive material;

(b) blending a first phenol-novolac resin and a second phenol-novolac resin to form a resin blend; and (c) mixing in a vessel the heated granular abrasive material and the resin blend, thereby producing the granular molding material.

2. The method of claim 1 wherein the granular abrasive material is heated to a temperature in a range of between about 80° C. and about 130° C.

3. The method of claim 1 wherein the heated granular abrasive material is in the vessel and the resin blend is added to the heated granular abrasive material in the vessel.

4. The method of claim 1 wherein the first phenol-novolac resin has a phenol:

formaldehyde molar ratio in the range of about 1:0.2 to about 1:0.35.

5. The method of claim 1 wherein the second phenol-novolac resin has a phenol:formaldehyde ratio in the range of about 1:0.5 to about 1:0.9.

6. The method of claim 1 wherein the second phenol-novolac resin is in the form of a dry powder.

7. The method of claim 6 wherein the first phenol-novolac resin is in a solid particulate state.

8. The method of claim 7 wherein the first phenol-novolac resin is blended with the second phenol-novolac by mechanical mixing.

9. The method of claim 6 wherein the first phenol-novolac is in a fluid state.

10. The method of claim 9 wherein the first phenol-novolac resin is blended with the second phenol-novolac resin by spraying the first phenol-novolac resin onto the second phenol-novolac resin.

11. The method of claim 1 further including the step of preheating the vessel.

12. The method of claim 11 wherein the vessel is preheated to a temperature of between about 20° C. and about 150° C.

13. The method of claim 11 wherein the vessel is preheated by directing a heated gas across the vessel.

14. The method of claim 11 wherein the vessel is preheated by directing a heated gas into the vessel.

15. The method of claim 1 wherein the temperature of the granular abrasive material is controlled in the vessel by directing a gas across the vessel.

16. The method of claim 1 wherein the temperature of the granular abrasive material is controlled in the vessel by directing a gas into the vessel.

17. The method of claim 1 further including the step of adding a curing agent to the vessel.

18. The method of claim 17 wherein the second phenol-novolac resin is present in a composition that includes the curing agent.

19. The method of claim 1 further including the step of adding a filler to the vessel.

20. The method of claim 19 wherein the second phenol-novolac resin is present in a composition that includes the filler.

21. The method of claim 1 wherein the granular abrasive material is selected from the group consisting of conventional abrasives, superabrasives and combinations thereof.

22. The method of claim 21 wherein the granular abrasive material is selected from the group consisting of aluminum oxide, sol gel alumina, zirconia alumina, silicon carbide, diamond, cubic boron nitride and mixtures thereof.

23. The method of claim 21 wherein the granular abrasive material has an average particle size in the range of between about 0.5 micrometers and about 5000 micrometers.

24. The method of claim 1 wherein mixing is conducted at a temperature ranging from about 85° C. and about 130° C.

25. The method of claim 24 wherein the first phenol-novolac resin and the second phenol-novolac resin have a molar ratio that ranges from about 0.7:1.0 to about 1.5:1.0.

26. The method of claim 25 wherein mixing is conducted at a temperature ranging from about 85° C. to about 110° C. and the volume % ratio of the first phenol-novolac resin to the second phenol-novolac resin ranges from about 50 to about 65%.

27. The method of claim 1 further including the step of molding said granular molding material.

28. The method of claim 27 wherein the granular material is molded by pressing the granular molding material at a temperature in a range of between about 30° C. and about 150° C.

29. The method of claim 28, further including the step of curing the granular molding material.

30. The method of claim 27, wherein the granular molding material is molded by pressing at a temperature of less than 30° C.

31. The method of claim 30, wherein molding is conducted at a pressure in a range of between about 0.5 tsi and about 15 tsi.

32. The method of claim 31, further including the steps of curing the granular molding material.

33. The method of claim 1 further including the step of cooling the granular molding material.

34. The method of claim 33 wherein the granular molding material is cooled by directing a cooling gas across the vessel.

35. The method of claim 33 wherein the granular molding material is cooled by directing a cooling gas into the vessel.

36. The method of claim 1 wherein the vessel is thermally insulated.

37. The method of claim 1 wherein the vessel is equipped with a heating jacket.

* * * * *